US010580369B2

(12) United States Patent
Chen

(10) Patent No.: US 10,580,369 B2
(45) Date of Patent: Mar. 3, 2020

(54) DISPLAY APPARATUS AND METHOD FOR DRIVING THE SAME

(71) Applicants: HKC Corporation Limited, Shenzhen (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 120 days.

(21) Appl. No.: 15/743,964

(22) PCT Filed: May 26, 2017

(86) PCT No.: PCT/CN2017/086130

§ 371 (c)(1),
(2) Date: Jan. 11, 2018

(87) PCT Pub. No.: WO2018/113189

PCT Pub. Date: Jun. 28, 2018

(65) Prior Publication Data

US 2018/0374436 A1 Dec. 27, 2018

(30) Foreign Application Priority Data

Dec. 20, 2016 (CN) ..... 2016 1 1187840

(51) Int. Cl.
*G09G 3/36* (2006.01)
*G09G 3/34* (2006.01)

(52) U.S. Cl.
CPC ..... *G09G 3/3607* (2013.01); *G09G 3/3696* (2013.01); *G09G 3/3406* (2013.01);
(Continued)

(58) Field of Classification Search
CPC combination set(s) only.
See application file for complete search history.

(56) References Cited

U.S. PATENT DOCUMENTS

2011/0254879 A1* 10/2011 Mori ..... G09G 3/3607 345/690
2016/0148583 A1* 5/2016 Nakanishi ..... G09G 3/3225 345/691
2017/0154587 A1* 6/2017 Chen ..... G09G 3/2003

FOREIGN PATENT DOCUMENTS

CN 101009083 A 8/2007
CN 101089683 A 12/2007
(Continued)

*Primary Examiner* — Jennifer Mehmood
*Assistant Examiner* — Deeprose Subedi
(74) *Attorney, Agent, or Firm* — HoustonHogle LLP

(57) ABSTRACT

A method for driving a display apparatus includes: dividing pixels on a display panel into a plurality of pixel groups; each of the pixel groups includes an even number of sequentially adjacent pixels; calculating a display hue of each of the pixel groups according to an image input signal; obtaining a Look Up Table (LUT) according to a hue range of the display hue; the LUT is a correspondence table between color gray scale values of blue sub-pixels and driving voltage pairs; the driving voltage pair comprises a high driving voltage and a low driving voltage; obtaining the driving voltage pair using the corresponding LUT according to an average gray scale value of the blue sub-pixels in each of the pixel groups; and driving the blue sub-pixels on the corresponding pixel group according to the driving voltage pair.

17 Claims, 10 Drawing Sheets

(52) U.S. Cl.
CPC ..... *G09G 2300/0447* (2013.01); *G09G 2300/0452* (2013.01); *G09G 2320/028* (2013.01); *G09G 2320/0242* (2013.01); *G09G 2320/068* (2013.01); *G09G 2320/0666* (2013.01); *G09G 2360/16* (2013.01)

(56) References Cited

FOREIGN PATENT DOCUMENTS

| | | | |
|---|---|---|---|
| CN | 101800035 | A | 8/2010 |
| CN | 102246222 | B | 11/2011 |
| CN | 104299592 | | 1/2015 |
| CN | 104835468 | | 8/2015 |
| CN | 104900203 | | 9/2015 |
| CN | 106683627 | A | 5/2017 |
| KR | 20110038321 | | 4/2011 |
| WO | 2016171096 | A1 | 10/2016 |

* cited by examiner

DISPLAY APPARATUS AND METHOD FOR DRIVING THE SAME

CROSS REFERENCE TO RELATED APPLICATION

This application is a § 371 National Phase Application of International Application No. PCT/CN2017/086130, filed on May 26, 2017, which claims priority to Chinese Patent Application No. 201611187840.9, entitled "LIQUID CRYSTAL DISPLAY APPARATUS AND METHOD FOR DRIVING THE SAME" filed on Dec. 20, 2016, the contents of which are expressly incorporated by reference herein in their entirety.

FIELD OF THE INVENTION

The present disclosure relates to a field of liquid crystal display (LCD) technology, and particularly relates to a display apparatus and a method for driving the same.

BACKGROUND OF THE INVENTION

Most conventional large-sized display apparatuses adopt negative vertical alignment (VA) liquid crystal technology or in-plane switching (IPS) liquid crystal technology. As to the driving of a VA liquid crystal in a large viewing angle, the brightness is rapidly saturated with the driving voltage, so that the viewing angle color shift is serious and the quality of the image is affected. Since a tendency of brightness saturation of a blue sub-pixel in the side view with the increasing of the gray scale is rapider and more pronounced than that of a red sub-pixel and a green sub-pixel, the quality of an image will show a significant deficiency of blue color shift in the mixed color view.

SUMMARY

According to various embodiments of the present disclosure, a display apparatus and a method for driving the same are provided, which can improve the deficiency of viewing angle color cast.

A method for driving a display apparatus includes:

dividing pixels on a display panel into a plurality of pixel groups; each of the pixel groups includes an even number of sequentially adjacent pixels;

calculating a display hue of each of the pixel groups according to an image input signal;

obtaining a Look Up Table (LUT) according to a hue range of the display hue; the LUT is a correspondence table between color gray scale values of the blue sub-pixels and driving voltage pairs; the driving voltage pair includes a high driving voltage and a low driving voltage;

obtaining the driving voltage pair using the corresponding LUT according to an average gray scale value of the blue sub-pixels in each of the pixel groups; and driving the blue sub-pixels on the corresponding pixel group according to the driving voltage pair.

According to an embodiment, in the step of dividing the pixels on the display panel into the plurality of pixel groups, each of the pixel groups includes the even number of sequentially and laterally adjacent pixels or sequentially and vertically adjacent pixels.

According to an embodiment, the step of calculating the display hue of each of the pixel groups according to the image input signal includes:

calculating an average gray scale value of various colors sub-pixels in each of the pixel groups according to the image input signal; and calculating the display hue of each of the pixel groups according to the average gray scale value of the various colors sub-pixels in each of the pixel groups in the image input signal.

According to an embodiment, in the step of calculating the display hue of each of the pixel groups according to the image input signal, the method further includes a step of calculating a color purity in each of the pixel groups according to the image input signal;

the step of obtaining the LUT according to the hue range of the display hue is: obtaining the corresponding LUT according to the range of the display hue and the color purity in each of the pixel groups.

According to an embodiment, the method further includes a step of prestoring a correspondence relation of the various hue ranges and the LUTS, and prestoring the LUT.

According to an embodiment, the step of driving the blue sub-pixels on the corresponding pixel group according to the driving voltage pair includes:

dividing each of the pixel groups into two adjacent pixel units; and driving the blue sub-pixels in the two pixel units by the driving voltage pair, respectively.

According to an embodiment, in the step of driving the blue sub-pixels in the two pixel units by the driving voltage pair, respectively, the driving voltages controlling the blue sub-pixels in the two adjacent pixel units are different.

According to an embodiment, each of the pixel groups both includes two laterally adjacent blue sub-pixels or two vertically adjacent blue sub-pixels; the step of driving the blue sub-pixels on the corresponding pixel group according to the driving voltage pair is: driving the two blue sub-pixels on the corresponding pixel group according to the driving voltage pair, respectively.

A display apparatus includes:

a display panel, pixels on the display panel are divided into a plurality of pixel groups; each of the pixel groups includes an even number of sequentially adjacent pixels;

a backlight module used to provide backlight to the display panel;

a control element including one or more processors, and a memory storing computer executable instructions, which, when executed by the one or more processors cause the one or more processors to perform steps in the following units:

a calculating unit used to calculate a display hue of each of the pixel groups according to an image input signal; and an obtaining unit used to obtain a LUT according to a hue range of the display hue; the LUT is a correspondence table between color gray scale values of the blue sub-pixels and driving voltage pairs; the driving voltage pair includes a high driving voltage and a low driving voltage;

the obtaining unit is further used to obtain the driving voltage pair using the corresponding LUT according to an average gray scale value of the blue sub-pixels in each of the pixel groups; and a driving element connected to the control element and the display panel, respectively; the driving element is used to drive the blue sub-pixels on the corresponding pixel group according to the driving voltage pair.

According to an embodiment, each of the pixel groups on the display panel includes an even number of sequentially and laterally adjacent pixels or sequentially and vertically adjacent pixels.

According to an embodiment, the calculating unit is further used to calculate an average gray scale value of various colors sub-pixels in each of the pixel groups according to the image input signal, and calculate the display hue of each of the pixel groups according to the average gray scale value of the various colors sub-pixels in each of the pixel groups in the image input signal.

According to an embodiment, the calculating unit is further used to calculate a color purity in each of the pixel groups according to the image input signal; and the obtaining unit is further used to obtain the corresponding LUT according to a range of the display hue and the color purity in each of the pixel groups.

According to an embodiment, the display apparatus further includes a memory used to prestore a correspondence relation of the various hue ranges and the LUTS, and prestore the LUT.

According to an embodiment, each of the pixel groups on the display panel is divided into two adjacent pixel units; and the driving element is used to drive the blue sub-pixels in the two pixel units by the driving voltage pair, respectively.

According to an embodiment, when the driving element drives the blue sub-pixels in two pixel units according to the driving voltage pair, respectively, the driving voltages controlling the blue sub-pixels in the two adjacent pixel units are different.

According to an embodiment, each of the pixel groups both includes two laterally adjacent blue sub-pixels or two vertically adjacent blue sub-pixels; the driving element is used to drive the two blue sub-pixels on the corresponding pixel group according to the driving voltage pair, respectively.

According to an embodiment, the display panel is a flat display panel or a curved display panel.

A display apparatus includes:

a display panel, pixels on the display panel are divided into a plurality of pixel groups; each of the pixel groups includes an even number of sequentially and laterally adjacent pixels or sequentially and vertically adjacent pixels; each of the pixel groups is divided into two adjacent pixel units;

a backlight module used to provide backlight to the display panel;

a control element including one or more processors, and a memory storing computer executable instructions, which, when executed by the one or more processors cause the one or more processors to perform steps in the following units:

a calculating unit used to calculate an average gray scale value of various colors sub-pixels in each of the pixel groups according to an image input signal, and calculate a display hue of each of the pixel groups according to the average gray scale value of the various colors sub-pixels in each of the pixel groups in the image input signal, the calculating unit is further used to calculate a color purity in each of the pixel groups according to the image input signal; and an obtaining unit used to obtain a corresponding LUT according to a range of the display hue and the color purity; the LUT is a correspondence table between color gray scale values of blue sub-pixels and driving voltage pairs; the driving voltage pair includes a high driving voltage and a low driving voltage;

the obtaining unit is further used to obtain the driving voltage pair using the corresponding LUT according to the average gray scale value of the blue sub-pixels in each of the pixel groups; and a driving element connected to the control element and the display panel, respectively; the driving element is used to drive the blue sub-pixels in the two pixel units of the corresponding pixel group according to the driving voltage pair.

According to an embodiment, when the driving element drives the blue sub-pixels in two pixel units according to the driving voltage pair, respectively, the driving voltages controlling the blue sub-pixels in the two adjacent pixel units are different.

According to the aforementioned display apparatus and the method for driving the same, the driving voltage pair having a high voltage and a low voltage is selected to perform the driving according to the range of the display hue of each of the pixel groups on the display panel. By driving the blue sub-pixels in each of the sub-pixel groups via the high and low voltage, such that the brightness variation of the blue sub-pixels in the side view can be controlled. Therefore a saturation tendency of the blue sub-pixels in the side view is approximate to the red sub-pixels and the blue sub-pixels or is approximate to a tendency of brightness saturation curves of the red sub-pixels, green sub-pixels, and the blue sub-pixels in the front view, thereby reducing the deficiency of the viewing color shift. At the same time, a plurality of driving voltage pairs are formed to drive the blue sub-pixels, which can ensure that the brightness of the remedied image is approximate to a target brightness, and the deficiency of color shift caused by premature saturation of blue sub-pixels in the large view can be effectively improved.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. The accompanying drawings in the following description are only some embodiments of the present invention, and persons of ordinary skill in the art can derive other obvious variations from the accompanying drawings without creative efforts.

DETAILED DESCRIPTION OF THE EMBODIMENTS

Embodiments of the present disclosure are described more fully hereinafter with reference to the accompanying drawings, in which some embodiments of the present disclosure are shown. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Figure 1:
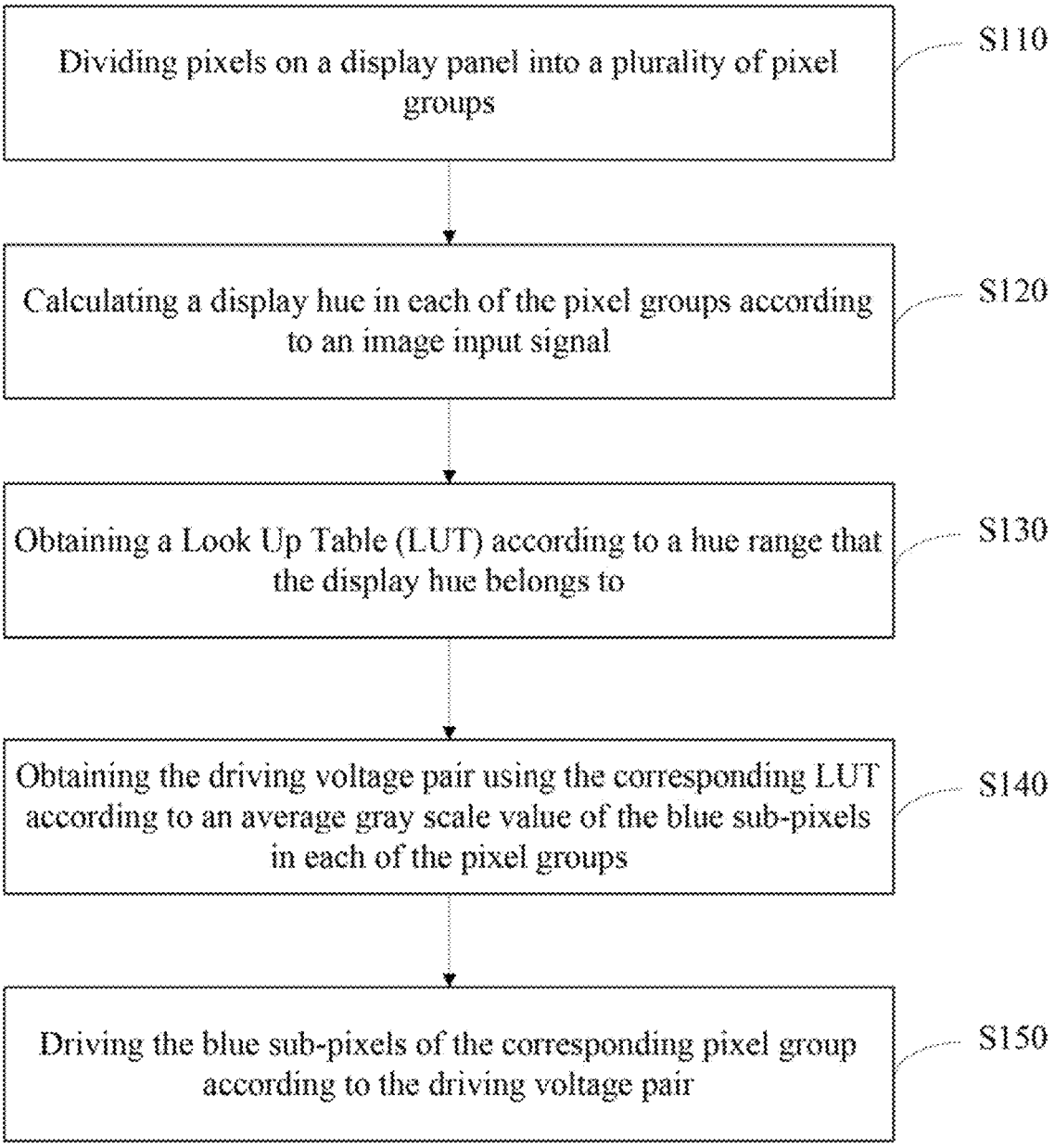
FIG. 1 is a flowchart of a method for driving a display apparatus according to an embodiment.

FIG. 1 is a flowchart of a method for driving a display apparatus according to an embodiment. The method for driving the display apparatus can improve the deficiency of color shift (or color aberration) caused by refractive index mismatch of the liquid crystal in the large view. The display apparatus can be a liquid crystal display (LCD) apparatus, an organic light emitting diode (OLED) display apparatus, a quantum light emitting diode (QLED) display apparatus and so on, whilst the display apparatus can be a flat display apparatus or a curved display apparatus. It should be noted that the display apparatus includes the aforementioned examples but is not limited thereto. When the display apparatus is the LCD apparatus, it can be the LCD apparatus such as a twisted nematic (TN), an optically compensated bend (OCB), or a vertical alignment (VA) apparatus. The backlight of the LCD may apply direct-lit backlight, the backlight source can be a white light source, a RGB three color light source, a RGBW four color light source or a RGBY four color light source, but is not limited thereto.

Referring to FIG. 1, the method for driving the display apparatus includes the following steps:

In step S110, pixels on a display panel is divided into a plurality of pixel groups.

Figure 2:
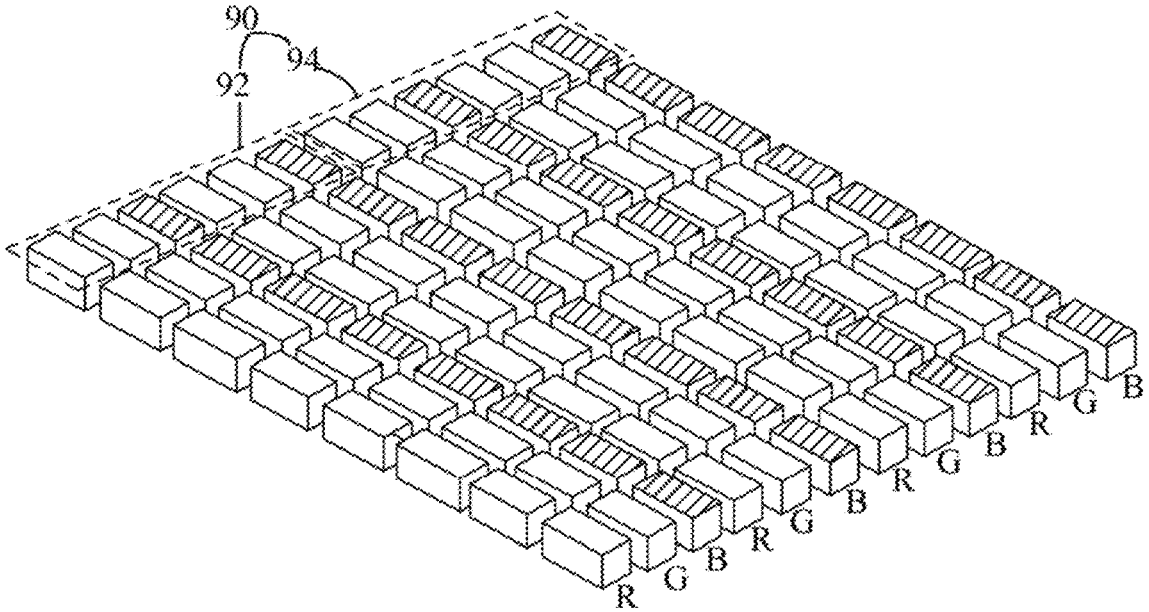
FIGS. 2 to 5 are schematic diagrams of dividing pixels on a display panel according to different embodiments.
Figure 3:
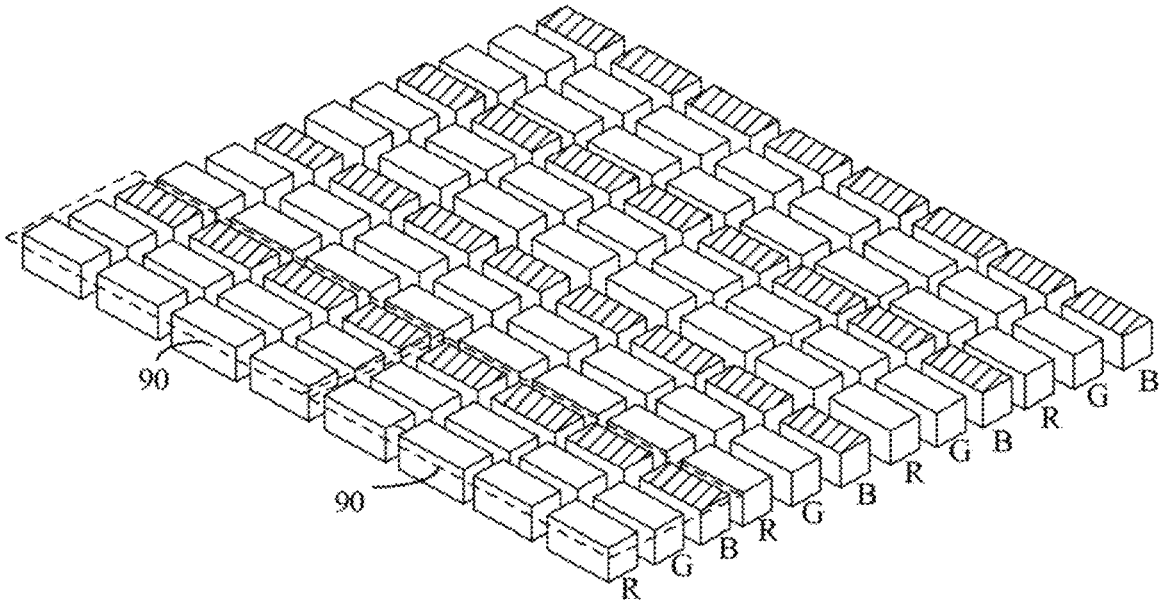
Figure 4:
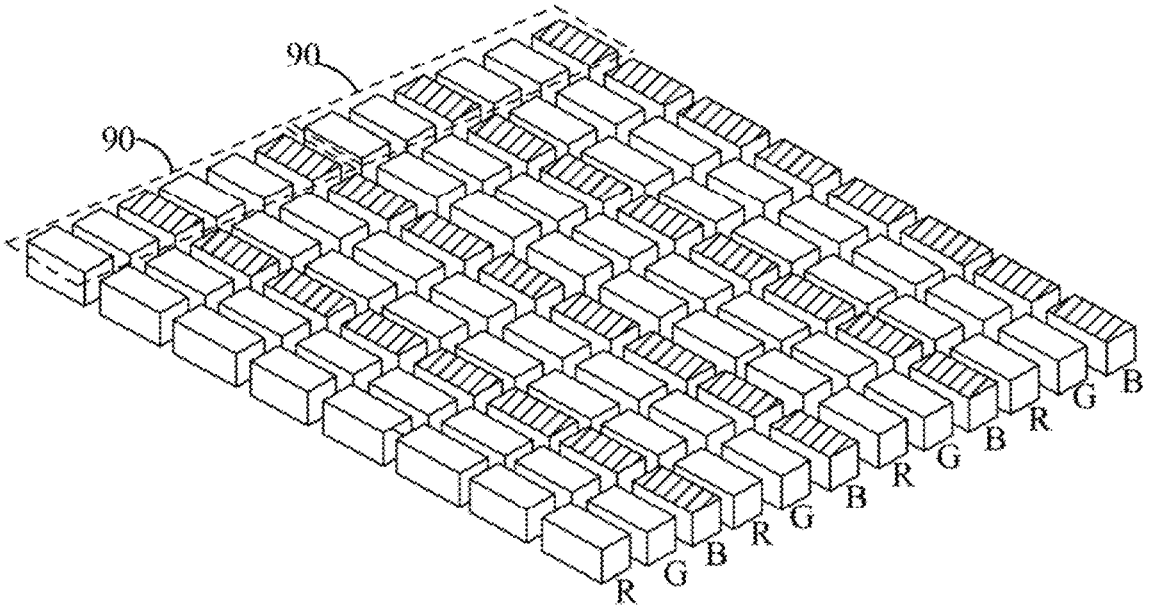
Figure 5:
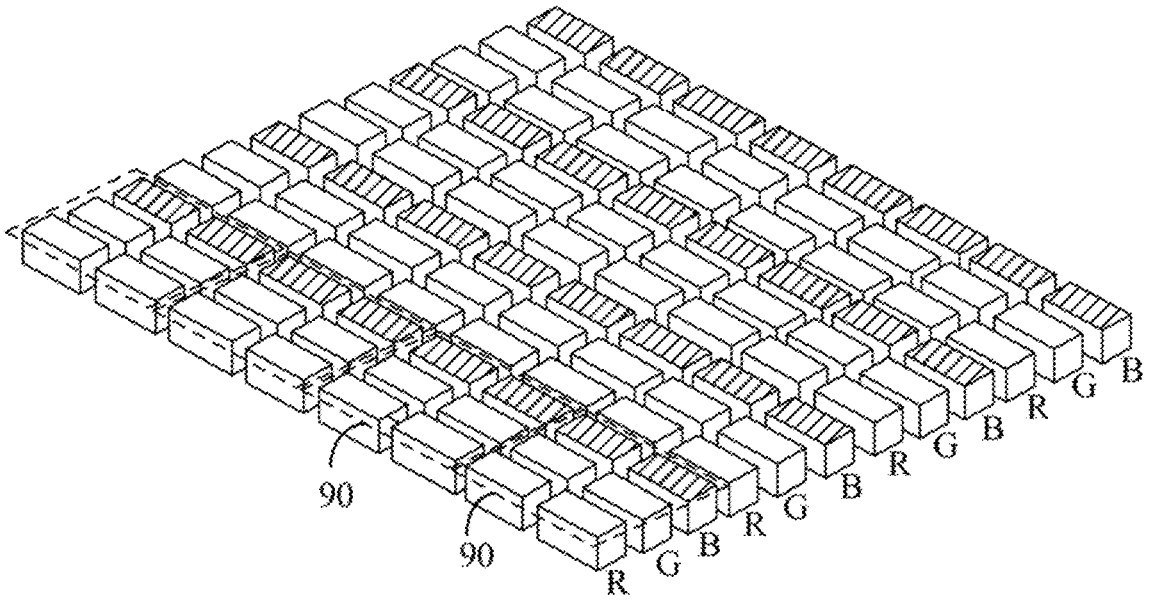

After division, each of the pixel groups includes an even number of sequentially adjacent pixels. Specifically, an even number of pixels can be sequentially and laterally adjacent or sequentially and vertically adjacent. FIG. 2 is a schematic diagram of dividing the pixels according to an embodiment. In the illustrated embodiment, each of the pixel groups 90 includes four laterally adjacent pixels. Each of the pixels includes a red sub-pixel R, a green sub-pixel G, and a blue sub-pixel B, which are arranged adjacent to each other (i.e., each of the pixel groups 90 includes four blue sub-pixels), and the four laterally adjacent pixels are divided into two adjacent pixel units 92 and 94. FIG. 3 is a schematic diagram of dividing the pixels according to another embodiment. In the illustrated embodiment, each of the pixel groups 90 includes four vertically adjacent pixels (i.e., includes four blue sub-pixels). FIG. 4 is a schematic diagram of dividing the pixels according to yet another embodiment. In the illustrated embodiment, each of the pixel groups 90 includes two laterally adjacent pixels. In an alternative embodiment, each of the pixel groups 90 includes two vertically adjacent pixels, as shown in FIG. 5. It should be noted that the method of dividing the pixels on the display panel includes the aforementioned example but is not limited thereto.

In step S120, a display hue of each of the pixel groups is calculated according to an image input signal.

Figure 6:
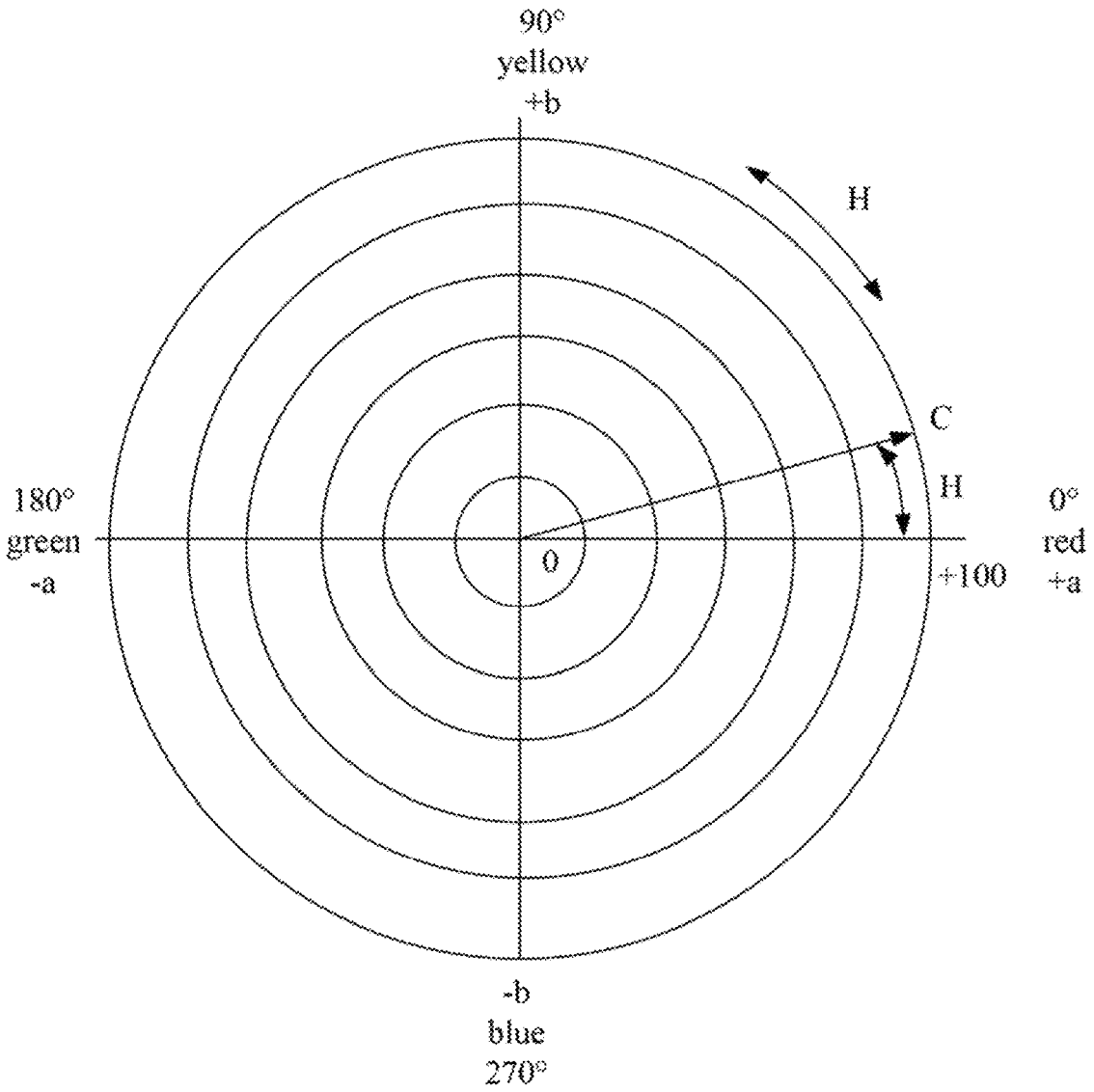
FIG. 6 is a schematic diagram of a CIE LCH color space system employed in step S120 in FIG. 1.

The display hue is calculated based on CIE LCH color space system and referring to function of each color space coordinates of the CIE specification. Specifically, L=f1(R, G, B), C=f2(R, G, B), H=f3(R, G, B). L represents the brightness, C represents ae color purity, which indicates the brilliance degree of the color. H represents the display hue, i.e., color representation. The above function relationship can be learned according to the CIE specification. A CIE LCH color space system is shown in FIG. 6. FIG. 6 only shows the locations of the major and representative colors such as red, yellow, green and blue, without indications on the locations of other colors. Since the CIE LCH color space system is a color space system known to a person of ordinary skill in the art, merely providing FIG. 6 should be sufficient for a person of ordinary skill in the art to understand the full situation of the CIE LCH color space system. In the CIE LCH color space system, 0 to 360° represents different hue presentations, where the red is defined as 0°, the yellow is defined as 90°, the green is defined as 180°, and the blue is defined as 270°. The display hue H in each of the pixel groups can be calculated and obtained by an average driving voltage of the pixel group.

Specifically, each of the pixels includes the red sub-pixel, the green sub-pixel, and the blue sub-pixel. An average gray scale value R'n, G'n, and B'n of the current various colors sub-pixels in each of the pixel groups are calculated firstly.

$$R'n=\text{Average}(R1+R2+\ldots+Rm)$$

$$G'n=\text{Average}(G1+G1+\ldots+Gm)$$

$$B'n=\text{Average}(B1+B2+\ldots+Bm)$$

N represents a serial number of the divided pixel group, in represents a serial number of the same color sub-pixels of the red sub-pixel, the green sub-pixel, and the blue sub-pixel in the pixel group n. In the illustrated embodiment, taking the division in FIG. 4 and FIG. 5 as an example, the average gray scale value R'n, G'n, and B'n of the red sub-pixel, the green sub-pixel, and the blue sub-pixel in each of the pixel groups are as follows:

$$R'n=\text{Average}(Rn+Rn+1),\ n=1, 3, 5\ldots$$

$$G'n=\text{Average}(Gn+Gn+1),\ n=1, 3, 5\ldots$$

$$B'n=\text{Average}(Bn+Bn+1),\ n=1, 3, 5\ldots$$

At this time, n represents a respective serial number of the same color sub-pixels of the red sub-pixel, the green sub-pixel, and the blue sub-pixel in the entire display panel.

Thus the display hue of the corresponding pixel group can be obtained by substituting the aforementioned average gray scale value R'n, G'n, and B'n to the function relation H=f3(R, G, B), i.e.:

$$H=f3(R'n,\ G'n,\ B'n)$$

According to an embodiment, the color purity C in each of the pixel groups can also be obtained according to the aforementioned average gray scale value. C is ranged from 0 to 100, whereby at 100 is the brightest. The value of C, to a certain extent, represents the voltage signal when the display apparatus is being driven. The color purity of the corresponding pixel group can be obtained by substituting the aforementioned average gray scale value R'n, G'n, and B'n to the function relation C=f2(R, G, B), i.e.:

$$C=f2(R'n,\ G'n,\ B'n)$$

In step S130, a Look Up Table (LUT) is obtained according to a hue range of the display hue.

Prior to determining the hue range of the display hue of each of the pixel groups, the hue values are divided into a preset number of range areas beforehand. Each of the range areas can be determined according to the extent to which the color cast needs to be improved. In the illustrated embodiment, the hue value is divided into six areas: a first area, $0° < H \leq 45°$ and $315° < H \leq 360°$; a second area, $45° < H \leq 135°$; a third area, $135° < H \leq 205°$; a fourth area, $205° < H \leq 245°$; a fifth area, $245° < H \leq 295°$; and a sixth area, $295° < H \leq 315°$. Thus the range of the display hue can be determined according to the calculated display hue of each of the pixel groups. It should be noted that the display hue value can be divided according to an actual requirement but is not limited thereto.

Figure 7:
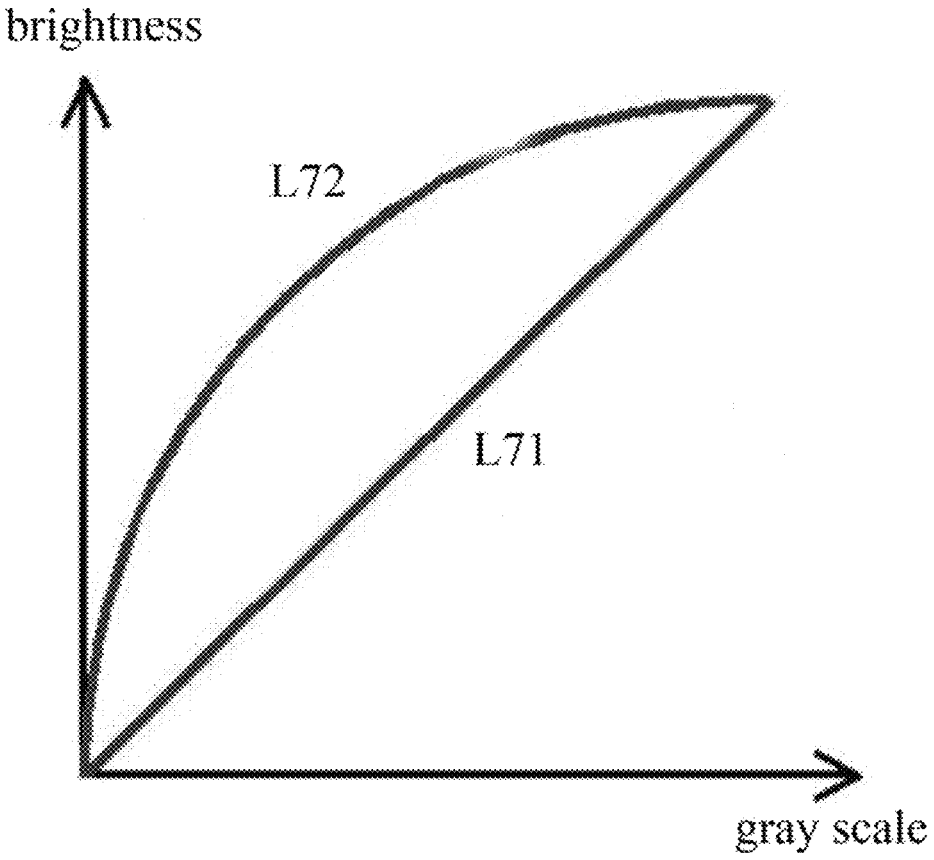
FIG. 7 is a graphic diagram illustrating a comparison of curves of brightness of the blue sub-pixels varying with gray scale in the front view and in the side view when adopting a single driving voltage to perform the driving.
Figure 8:
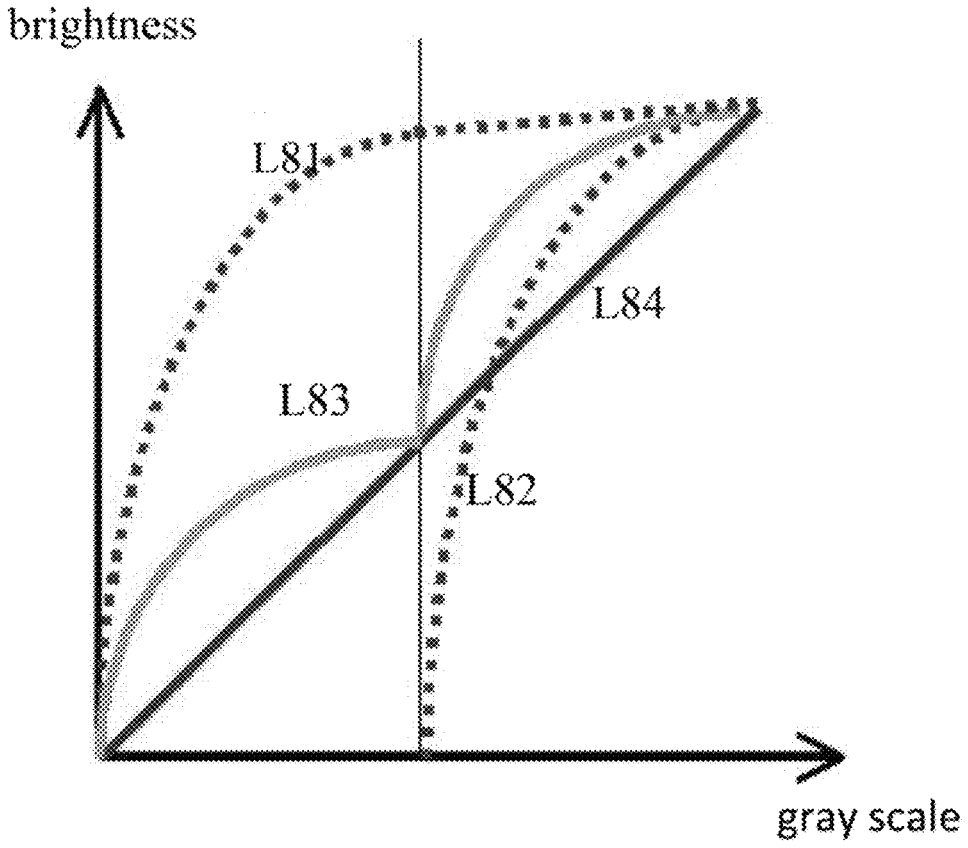
FIG. 8 is a graphic diagram illustrating curves of the brightness of the blue sub-pixels varying with the gray scale in the side view when adopting a high driving voltage, a low driving voltage, and a high and low driving voltage pair to perform the driving, respectively.

The LUT is a correspondence table between a color gray scale value of the blue sub-pixels and the driving voltage pair. The driving voltage pair includes a high driving voltage and a low driving voltage (i.e., consists of the high driving voltage B'H and the low driving voltage B'L). Specifically, the color gray scale values 0 to 255 of the blue sub-pixel of the LUT correspond to 256 pair high and low driving voltage signals. Each group of the high and low driving voltage is capable of making a curve of brightness of the adjusted blue sub-pixel varying with the gray scale in the side view more approximate to a curve of brightness of the adjusted blue sub-pixel varying with the gray scale in the front view. By driving the blue sub-pixels in each of the sub-pixel groups via the high and low voltage, the brightness variation of the blue sub-pixels in the side view can be controlled. Therefore a saturation tendency of the blue sub-pixel in the side view is approximate to the red sub-pixels and the blue sub-pixels or is approximate to a tendency of brightness saturation curves of the red sub-pixels, the green sub-pixels, and the blue sub-pixels in the front view, thereby reducing the deficiency of the viewing color shift. FIG. 7 is a curve of the brightness of the blue sub-pixels varying with the gray scale value in the front view and in the side view when a single driving voltage is adopted. Specifically, L71 represents a curve in the front view, and L72 represents a curve in the side view. Apparently, it is easy that the curve of the brightness of the blue sub-pixel varying with the gray scale value tends to be saturated easily in the side view, so that the quality of an image will show a significant deficiency of a bluish color shift in the mixed color view. FIG. 8 is a graphic diagram illustrating a comparison of the brightness variation curves in the side view when a high voltage driving and a low voltage driving are adopted, and when a high and low driving voltage pair is adopted to perform the driving. Specifically, L81 is a curve of brightness varying with the gray scale in the side view when a high voltage is used to drive. L82 is a curve of brightness varying with the gray scale in the side view when a low voltage is used to drive. L83 is a combination of L81 and L82, i.e., a curve of brightness varying with the gray scale after the high and low driving voltage pair is adopted, which is apparently more approximate to the curve L84 of the brightness varying with the gray scale in the front view, i.e., the viewing angle color shift is improved after the high and low voltage pair is adopted.

The different hue ranges have different effect on the viewing angle color shift, so that the different hue ranges correspond to the different LUTS. Therefore, the different hue ranges can be driven by a more suitable drive voltage pair corresponding to the hue range, which ensures that the brightness of the adjusted blue sub-pixel varying with gray scale in the side view is more approximate to the variation curve in the front view. There is a one-to-one correspondence between the LUT and the hue range, and the correspondence table can be prestored. For example, the first area corresponds to a first LUT, the second area corresponds to a second LUT, the third area corresponds to a third LUT, and so on. The correspondence table and the LUT can be stored in a memory at the same time, or stored respectively. The memory may be a storage apparatus within the display apparatus, or may be stored directly by an external storage apparatus which can be accessed externally if necessary. Therefore, the corresponding LUT can be readily determined according to the obtained hue range of respective pixel group.

In an alternative embodiment, the LUT is obtained according to the range of the display hue and the color purity. Specifically, different hue ranges have different color purity configurations. The range configuration corresponding to the color purity of different areas is determined according to the extent to which the color cast needs to be improved. For example, a first hue range area corresponds to a first color purity range $CTL1 \leq C \leq CTH1$; a second hue range area corresponds to a second color purity range $CTL2 \leq C \leq CTH2$; a third hue range area corresponds to a third color purity range $CTL3 \leq C \leq CTH3$, and so on. Thus the range of the display hue and the range of the color purity can be determined according to the calculated and obtained display hue and the color purity. Taking the illustrated embodiment as an example, when the display hue H and the color purity C both satisfy the following two conditions, the display hue and the color purity belong to a first range can be determined:

$$0° < H \leq 45° \text{ or } 315° < H \leq 360°$$

$$CTL1 \leq C \leq CTH1$$

when the display hue H and the color purity C both satisfy the following two conditions, the display hue and the color purity belong to a second range can be determined:

$$45° < H \leq 135°$$

$$CTL2 \leq C \leq CTH2$$

The corresponding LUT can be obtained according to the range of the display hue and the color purity.

In step S140, the driving voltage pair is obtained by using the corresponding LUT according to an average gray scale value of the blue sub-pixels in each of the pixel groups.

The different display hues and color purity correspond to the different LUTS, so that the final obtained driving voltage pair is much more approximate to the ideal driving voltage, therefore the brightness variation of the adjusted blue sub-pixel is much more approximate to the ideal condition.

In step S150, the blue sub-pixels on the corresponding pixel group are driven according to the driving voltage pair.

Figure 9:
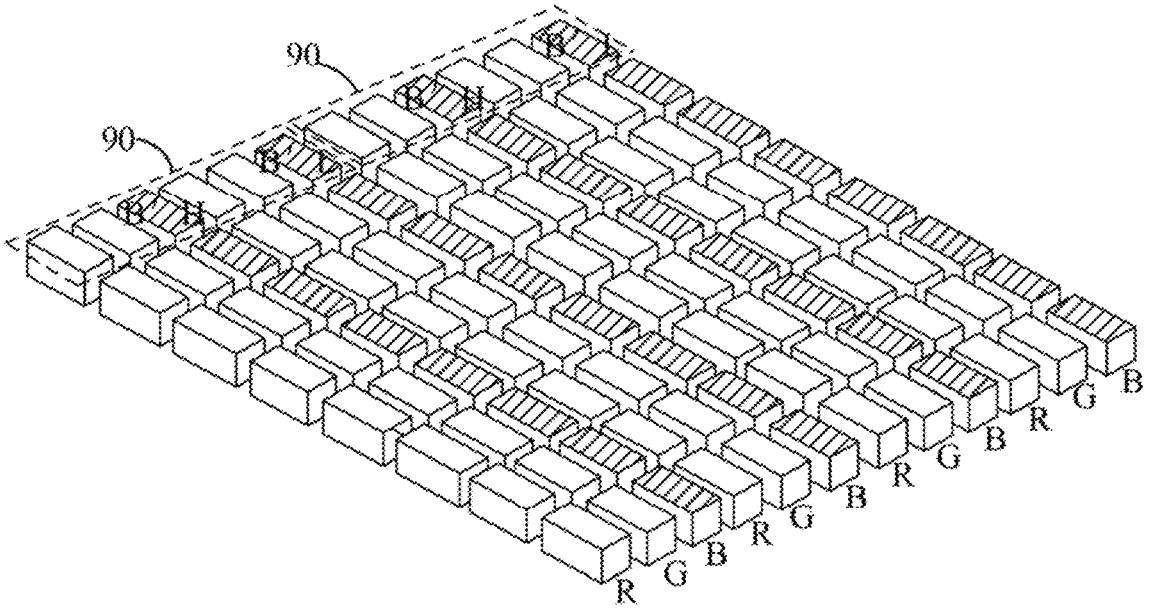
FIGS. 9 and 10 are schematic diagrams illustrating driving after S150 is performed.
Figure 10:
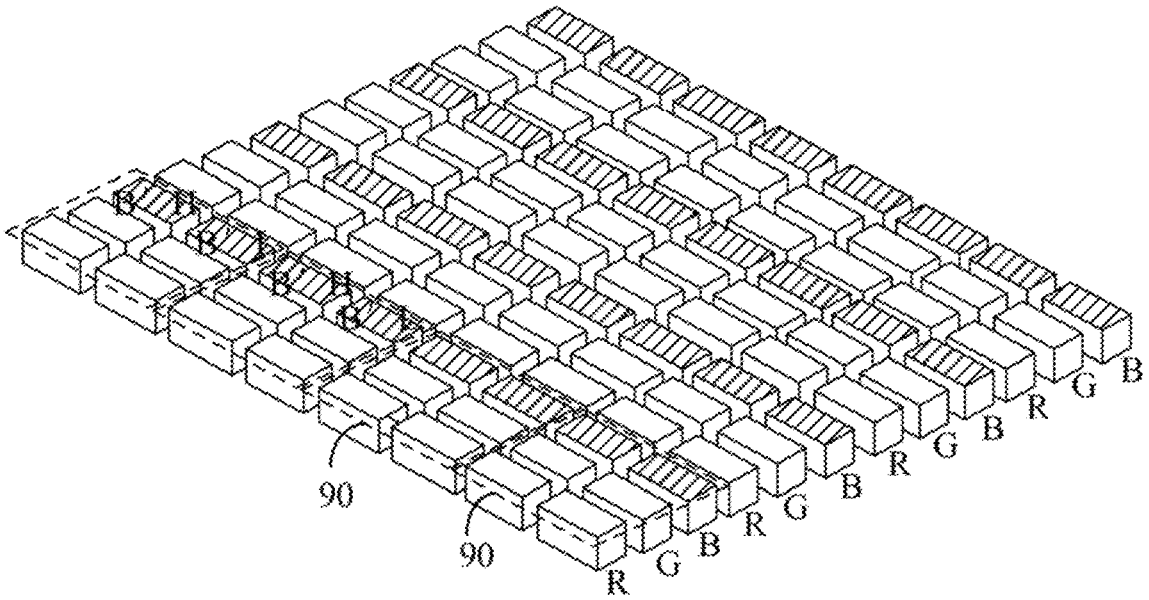

In the illustrated embodiment, the driving voltage pair is used to drive the two pixel units, respectively. The high driving voltage drives one of the pixel units, and the low driving voltage drives the other pixel unit so as to achieve the high and low interphase voltages driving of the adjacent blue sub-pixels, as shown in FIGS. 9 and 10. In the driving method of the illustrated embodiment, the other sub-pixels such as the red sub-pixel or the green sub-pixel can be driven according to a usual driving method.

According to the aforementioned method for driving the display apparatus, the corresponding driving voltage pair having a high voltage and a low voltage is selected to perform the driving according to the range of the display hue of each of the pixel groups on the display panel. The blue sub-pixels in each of the pixel groups is driven via the high and low voltage, such that the brightness variation of the blue sub-pixels in the side view can be controlled. Therefore a saturation tendency of the blue sub-pixel in the side view is approximate to the red sub-pixels and the blue sub-pixels or is approximate to a tendency of brightness saturation curves of the red sub-pixels, the green sub-pixels, and the blue sub-pixels in the front view, thereby reducing the deficiency of the viewing color shift. At the same time, by forming a plurality of driving voltage pairs to drive the blue sub-pixels, the brightness of the remedied image is approximate to a target brightness. Therefore the deficiency of color shift caused by premature saturation of blue sub-pixel in the large view can be effectively improved.

Figure 11:
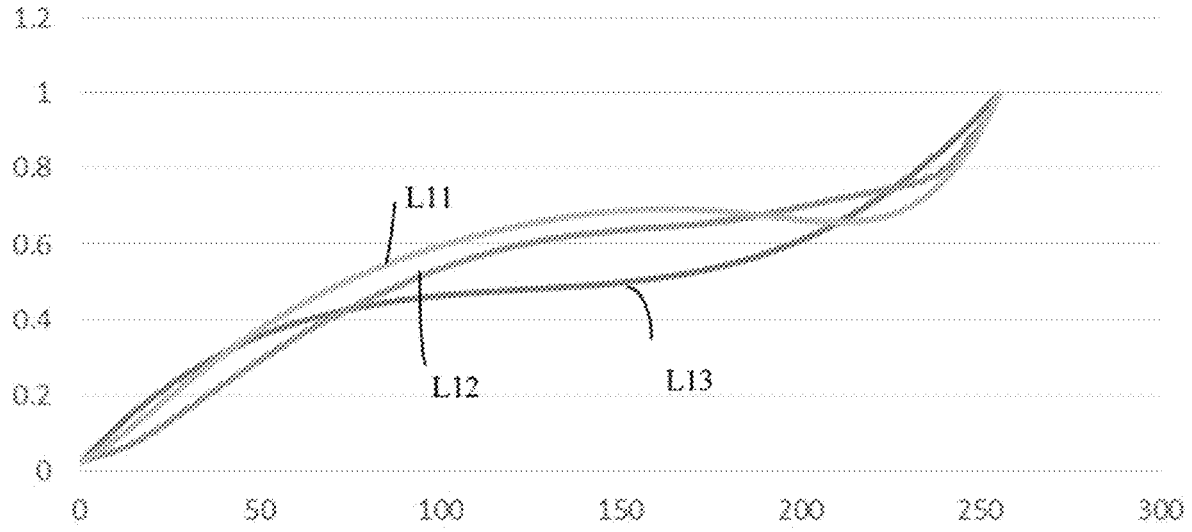
FIG. 11 is a graphic diagram illustrating a comparison of a curve of ideal brightness varying with the gray scale and curves of a respective brightness of two voltages combination varying with the gray scale.
Figure 12:
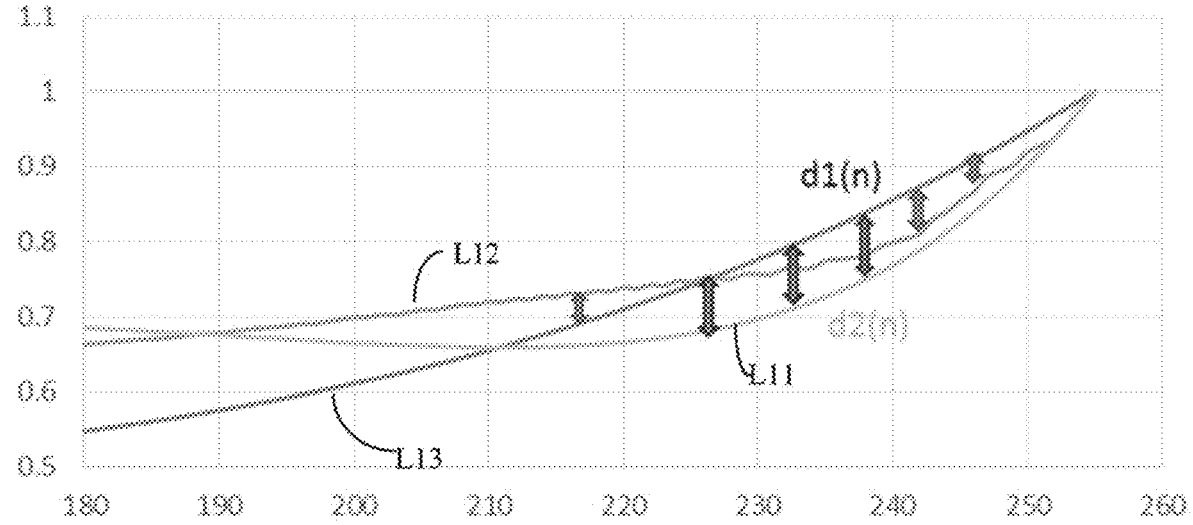
FIGS. 12 and 13 are partial enlarged views of FIG. 11.
Figure 13:
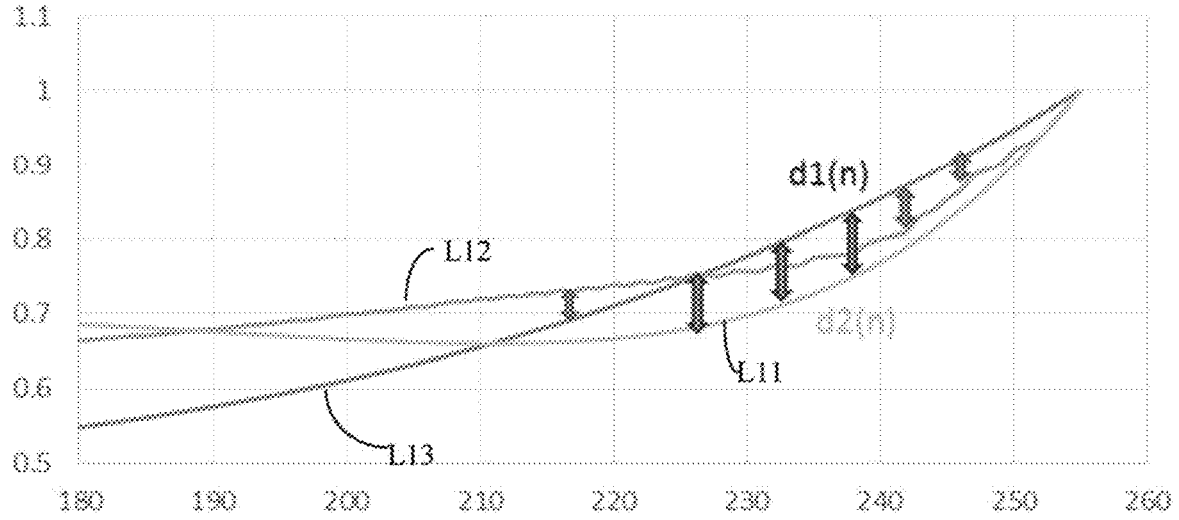

According to the aforementioned driving method, by dividing each pixels on the display panel into the plurality of groups, so that each of the pixel groups can be driven by adopting different high and low driving voltage pair according to the display hue, thereby reducing the deficiency of the viewing color shift. The importance of performing the driving by the plurality of groups of driving voltages respectively will be described with reference to the FIGS. 11 to 13 hereinafter. Referring to FIG. 11, target gamma is a curve of brightness of a target blue sub-pixel varying with the gray scale value, which corresponds to L13 in FIG. 11. The dividing of the blue sub-pixel has to satisfy a condition that the ratio of the RGB brightness does not change in the front view. There are several combinations of high and low voltage signals divided by the blue sub-pixel space, and the condition that the brightness saturation varying with the voltage in the side view caused by each combination is different. Referring to FIG. 11, the high and low voltage combinations, gamma1 and gamma2, which are divided by the blue sub-pixel space and for which the brightness is saturated and varies with voltage in the side view correspond to L12 and L11 in the drawing, respectively. FIGS. 12 and 13 are partial enlarged views of the FIG. 11. It can be seen from the FIGS. 11 to 13, when a group of a high and low voltage pair is adopted to drive the blue sub-pixels on the display panel, the saturation tendency of the curve of the brightness varying with the gray scale is rapider than that of the Target gamma, and therefore the problem of the side viewing angle color shift cannot be satisfactorily solved, i.e., the combination of the high voltage and the low voltage merely divided by one blue sub-pixel space cannot satisfy the requirement that the brightness of the high and low voltages is approximate to the target brightness at the same time.

As shown in FIG. 12, when a relation of variation between the low voltage (i.e., the low gray scale value) and the brightness is considered, the difference d1(n) between the actual brightness of the gamma1 and the target brightness is much larger than the difference d2(n) between the actual brightness of the gamma2 and the target brightness. However, as shown in FIG. 13, when a relation of variation between the high voltage (i.e., the high gray scale value) and the brightness is considered, the difference d1(n) between the actual brightness of the gamma1 and the target brightness is much smaller than the difference d2(n). That is, the gamma1 is suitable for a condition when the blue sub-pixel higher voltage signal (i.e., the high gray scale value) is presented on the image content. On the other hand, the gamma2 is suitable for a condition when the blue sub-pixel lower voltage signal (i.e., the low gray scale value) is presented on the image content. The driving method of the illustrated embodiment, which adopts different combinations of the high and low voltage to perform the driving for the different gray scale values, so that the aforementioned problem can be overcome, effectively. Moreover, after the aforementioned driving method is adopted, the pixels on the display panel need not be designed as a primary pixel and a secondary pixel, thereby greatly improving the penetration and resolution of a thin film transistor (TFT) display panel, and reducing the design costs of backlight.

Figure 14:
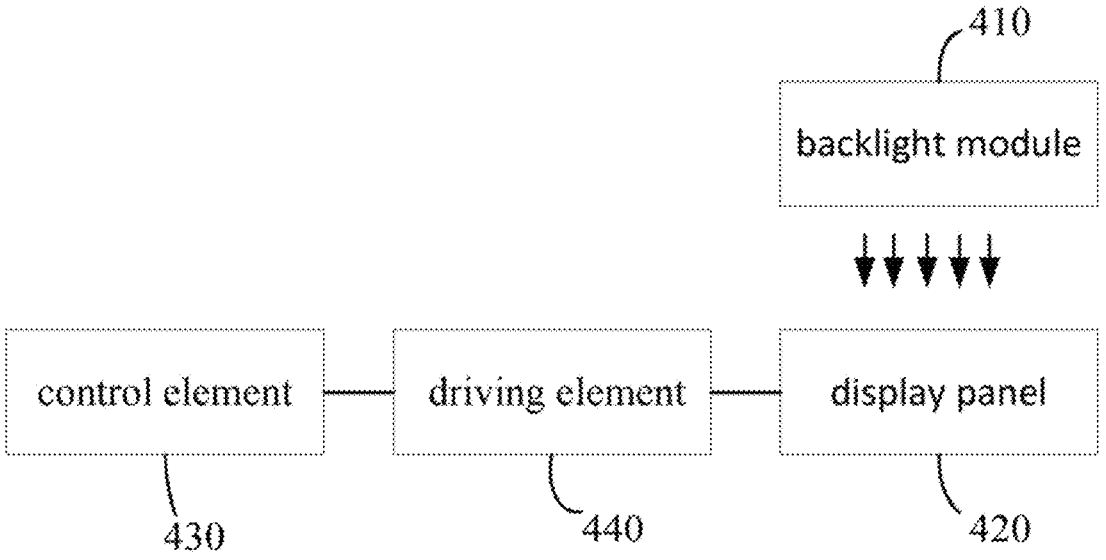
FIG. 14 is a block diagram of the display apparatus according to an embodiment.

The present disclosure also provides a display apparatus, as shown in FIG. 14. The display apparatus can perform the aforementioned driving method. The display apparatus includes a backlight module 410, a display panel 420, a control element 430, and a driving element 440. The control element 430 and the driving element 440 can be both integrated into the display panel 420, however, the backlight module 410 can be implemented by adopting an independent backlight module, directly. It should be noted that the manner of integrating the respective elements is not limited thereto.

The backlight module 410 is used to provide the backlight. The backlight module 410 can be direct-lit backlight or side-lit backlight. The backlight source can be a white light source, a RGB three color light source, a RGBW four color light source or a RGBY four color light source, but is not limited thereto.

The display panel 420 can be a liquid crystal display (LCD) panel, an organic light emitting diode (OLED) display panel, a quantum light emitting diode (QLED) display panel and so on, and at the same time, the display panel 420 can be a flat display panel or a curved display panel. It should be noted that the display panel 420 includes the aforementioned examples but is not limited thereto. When the display panel 420 is the LCD panel, it can be an LCD panel such as the TN, the OCB, or the VA apparatus. In the illustrated embodiment, the pixels on the display panel 420 are divided into a plurality of pixel groups. Each of the pixel groups includes an even number of sequentially adjacent pixels. The dividing method can be referred to FIGS. 2 to 5, but is not limited thereto.

Figure 15:
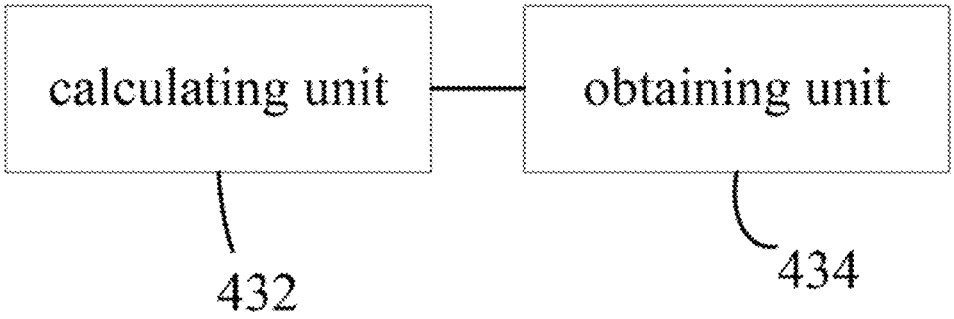
FIG. 15 is a block diagram of a control element according to an embodiment.

The control element 430 includes one or more processors, and a memory storing computer executable instructions, which, when executed by the one or more processors cause the one or more processors to perform steps of a calculating unit 432 and a obtaining unit 434, as shown in FIG. 15. And the calculating unit 432 is used to calculate the display hue of each of the pixel groups according to an image input signal. The obtaining unit 434 is used to obtain the corresponding LUT according to the hue range of the display hue. The LUT is a correspondence table between color gray scale values of blue sub-pixels and driving voltage pairs. The driving voltage pair includes a high driving voltage and a low driving voltage. The obtaining unit 434 is further used to obtain the driving voltage pair using the corresponding LUT according to an average gray scale value of the blue sub-pixels in each of the pixel groups. In alternative embodiment, the calculating unit 432 is further used to calculate the display hue of each of the pixel groups according to the image input signal. The obtaining unit 434 is further used to obtain the corresponding LUT according to the range of the display hue and the color purity in each of the pixel groups.

The driving element 440 is connected to the control element 430 and the display panel 420, respectively. The driving element 430 is used to drive the blue sub-pixels on the corresponding pixel group according to the driving voltage pair.

According to the aforementioned display apparatus, the corresponding driving voltage pair having a high voltage and a low voltage is selected to perform the driving according to the range of the display hue of each of the pixel groups on the display panel 420. By driving the blue sub-pixels in each of the pixel groups via the high and low voltage, such that the brightness variation of the blue sub-pixels in the side view can be controlled. Therefore a saturation tendency of the blue sub-pixel in the side view is approximate to the red sub-pixels and the blue sub-pixels or is approximate to a tendency of brightness saturation curves of the red sub-pixels, the green sub-pixels, and the blue sub-pixels in the front view, thereby reducing the deficiency of the viewing color shift. At the same time, by forming a plurality of driving voltage pairs to drive the blue sub-pixel, which can ensure that the brightness of the remedied image is approximate to a target brightness, and the deficiency of color shift caused by premature saturation of blue sub-pixels in the large view can be effectively improved.

In an alternative embodiment, the display apparatus can be a LCD apparatus, an OLED apparatus, and a QLED apparatus. At the same time, the display apparatus can be a flat display apparatus or curved display apparatus. When the display apparatus is not the LCD apparatus, the display apparatus may not include the backlight module 410.

Those of ordinary skills in the art can understand that the total or partial process of the aforementioned method can be achieved by an associated hardware instructed by a computer program. The program may be stored in a computer-readable storage medium. When the program is executed, the program can include the aforementioned process of the aforementioned embodiment of the methods. The storage medium may be a nonvolatile storage medium such as a magnetic disk, an optical disk, a read-only memory (ROM), or a random access memory (RAM).

The different technical features of the above embodiments can have various combinations which are not described for the purpose of brevity. Nevertheless, to the extent the combining of the different technical features does not conflict with each other, all such combinations must be regarded as within the scope of the disclosure.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A method for driving a display apparatus, comprising:

dividing pixels on a display panel into a plurality of pixel groups, wherein each of the pixel groups comprises an even number of sequentially adjacent pixels;

calculating a display hue of each of the pixel groups according to an image input signal and calculating a color purity in each of the pixel groups according to the image input signal;

obtaining a Look Up Table (LUT) according to a hue range of the display hue and the color purity in each of the pixel groups, wherein the LUT is a correspondence table between color gray scale values of blue sub-pixels and driving voltage pairs; the driving voltage pair comprises a high driving voltage and a low driving voltage;

obtaining the driving voltage pair using the corresponding LUT according to an average gray scale value of the blue sub-pixels in each of the pixel groups; and driving the blue sub-pixels on the corresponding pixel group according to the driving voltage pair.

2. The method according to claim 1, wherein in the step of dividing the pixels on the display panel into the plurality of pixel groups, each of the pixel groups comprises the even number of sequentially and laterally adjacent pixels or sequentially and vertically adjacent pixels.

3. The method according to claim 1, wherein the step of calculating the display hue of each of the pixel groups according to the image input signal comprises:

calculating an average gray scale value of various colors sub-pixels in each of the pixel groups according to the image input signal; and calculating the display hue of each of the pixel groups according to the average gray scale value of the various colors sub-pixels in each of the pixel groups in the image input signal.

4. The method according to claim 1, further comprising a step of prestoring a correspondence relation between the various hue ranges and the LUTS, and prestoring the LUT.

5. The method according to claim 1, wherein the step of driving the blue sub-pixels on the corresponding pixel group according to the driving voltage pair comprises:

dividing each of the pixel groups into two adjacent pixel units; and driving the blue sub-pixels in the two pixel units by the driving voltage pair, respectively.

6. The method according to claim 5, wherein in the step of driving the blue sub-pixels in the two pixel units by the driving voltage pair, respectively, the driving voltages controlling the blue sub-pixels in the two adjacent pixel units are different.

7. The method according to claim 5, wherein each of the pixel groups both comprises two laterally adjacent blue sub-pixels or two vertically adjacent blue sub-pixels; the step of driving the blue sub-pixels on the corresponding pixel group according to the driving voltage pair is: driving the two blue sub-pixels on the corresponding pixel group according to the driving voltage pair, respectively.

8. A display apparatus comprising:

a display panel, wherein pixels on the display panel are divided into a plurality of pixel groups; each of the pixel groups comprises an even number of sequentially adjacent pixels;

a backlight module configured to provide backlight to the display panel;

a control element comprising one or more processors, and a memory storing computer executable instructions, which, when executed by the one or more processors cause the one or more processors to perform steps in the following units:

a calculating unit configured to calculate a display hue of each of the pixel groups according to an image input signal and to calculate a color purity in each of the pixel groups according to the image input signal; and an obtaining unit configured to obtain a LUT according to a hue range of the display hue and the color purity in each of the pixel groups; wherein the LUT is a correspondence table between color gray scale values of blue sub-pixels and driving voltage pairs; the driving voltage pair comprises a high driving voltage and a low driving voltage;

wherein the obtaining unit is further configured to obtain the driving voltage pair using the corresponding LUT according to an average gray scale value of the blue sub-pixels in each of the pixel groups; and a driving element connected to the control element and the display panel, respectively, wherein the driving element is configured to drive the blue sub-pixels on the corresponding pixel group according to the driving voltage pair.

9. The display apparatus according to claim 8, wherein each of the pixel groups on the display panel comprises an even number of sequentially and laterally adjacent pixels or sequentially and vertically adjacent pixels.

10. The display apparatus according to claim 8, wherein the calculating unit is further configured to calculate an average gray scale value of various colors sub-pixels in each of the pixel groups according to the image input signal, and calculate the display hue of each of the pixel groups according to the average gray scale value of the various colors sub-pixels in each of the pixel groups in the image input signal.

11. The display apparatus according to claim 8, wherein the display apparatus further comprises a memory configured to prestore a correspondence relation between the various hue ranges and the LUTS, and prestore the LUT.

12. The display apparatus according to claim 8, wherein each of the pixel groups on the display panel is divided into two adjacent pixel units, and the driving element is configured to drive the blue sub-pixels in the two pixel units by the driving voltage pair, respectively.

13. The display apparatus according to claim 12, wherein when the driving element drives the blue sub-pixels in the two pixel units according to the driving voltage pair, respectively, the driving voltages controlling the blue sub-pixels in the two adjacent pixel units are different.

14. The display apparatus according to claim 12, wherein each of the pixel groups both comprises two laterally adjacent blue sub-pixels or two vertically adjacent blue sub-pixels; the driving element is configured to drive the two blue sub-pixels on the corresponding pixel group according to the driving voltage pair, respectively.

15. The display apparatus according to claim 8, wherein the display panel is a flat display panel or a curved display panel.

16. A display apparatus comprising:

a display panel, wherein pixels on the display panel are divided into a plurality of pixel groups, wherein each of the pixel groups comprises an even number of sequentially and laterally adjacent pixels or sequentially and vertically adjacent pixels; each of the pixel groups is divided into two adjacent pixel units;

a backlight module configured to provide backlight to the display panel;

a control element comprising one or more processors, and a memory storing computer executable instructions, which, when executed by the one or more processors cause the one or more processors to perform steps in the following units:

a calculating unit configured to calculate an average gray scale value of various colors sub-pixels in each of the pixel groups according to an image input signal, and calculate a display hue of each of the pixel groups according to the average gray scale value of the various colors sub-pixels in each of the pixel groups in the image input signal, wherein the calculating unit is further configured to calculate a color purity in each of the pixel groups according to the image input signal; and an obtaining unit configured to obtain a LUT according to a range of the display hue and the color purity; wherein the LUT is a correspondence table between color gray scale values of blue sub-pixels and driving voltage pairs; the driving voltage pair comprises a high driving voltage and a low driving voltage;

wherein the obtaining unit is further configured to obtain the driving voltage pair using the corresponding LUT according to the average gray scale value of the blue sub-pixels in each of the pixel groups; and a driving element connected to the control element and the display panel, respectively, wherein the driving element is configured to drive the blue sub-pixels in the two pixel units of the corresponding pixel group according to the driving voltage pair.

17. The display apparatus according to claim 16, wherein when the driving element drives the blue sub-pixels in two pixel units according to the driving voltage pair, respectively, the driving voltages controlling the blue sub-pixel in the two adjacent pixel units are different.

* * * * *